US012050021B1

(12) United States Patent
Chen et al.

(10) Patent No.: US 12,050,021 B1
(45) Date of Patent: Jul. 30, 2024

(54) COMPACT MULTIFUNCTIONAL BATHROOM MIRROR CABINET

(71) Applicant: LAMXON TECHNOLOGY BUILDING MATERIALS CO., LTD., Dongguan (CN)

(72) Inventors: Qingyuan Chen, Dongguan (CN); Chihsu Tu, Dongguan (CN); Qiang Chen, Dongguan (CN); Xinwei Li, Dongguan (CN)

(73) Assignee: LAMXON TECHNOLOGY BUILDING MATERIALS CO.,LTD., Dongguan (CN)

( * ) Notice: Subject to any disclaimer, the term of this patent is extended or adjusted under 35 U.S.C. 154(b) by 0 days.

(21) Appl. No.: 18/500,401

(22) Filed: Nov. 2, 2023

(30) Foreign Application Priority Data

Sep. 26, 2023 (CN) ..... 202311258172.4

(51) Int. Cl.
*A47B 67/02* (2006.01)
*A47B 67/00* (2006.01)
*F24F 3/153* (2006.01)

(52) U.S. Cl.
CPC ..... *F24F 3/153* (2013.01); *A47B 67/005* (2013.01); *A47B 67/02* (2013.01); *A47B 2220/0091* (2013.01)

(58) Field of Classification Search
CPC ..... A47B 67/02; A47B 67/005; A47B 2220/0091; F24F 3/153
USPC ..... 312/224, 225, 226, 227
See application file for complete search history.

(56) References Cited

U.S. PATENT DOCUMENTS 5,787,724 A * 8/1998 Pohl ..... F25D 23/028 312/401
9,675,172 B2 * 6/2017 Pandorf ..... A47B 67/02
2007/0013278 A1 * 1/2007 Herber ..... A47B 67/005 312/227
2015/0320209 A1 * 11/2015 Hasselback ..... A47B 95/00 312/227
2016/0047539 A1 * 2/2016 Cano ..... F21V 33/0012 362/133
2018/0258579 A1 * 9/2018 Kim ..... A61L 2/26
(Continued)

FOREIGN PATENT DOCUMENTS

CN 213429779 U 6/2021
CN 213909955 U 8/2021
CN 217547525 U 10/2022

*Primary Examiner* — James O Hansen
(74) *Attorney, Agent, or Firm* — Nitin Kaushik

(57) ABSTRACT

The invention relates to the technical field of smart mirror cabinets, and in particular, to a compact multifunctional bathroom mirror cabinet, including a cabinet body and a cabinet door. The cabinet door is rotatably connected to the cabinet body. The cabinet door is provided with an electric module. The cabinet body is provided with a control module. The electric module is connected with a wireless receiving module, the control module is connected with a wireless transmitting module, and the wireless transmitting module is signal connected with the wireless receiving module. The present invention realizes signal transmission between the cabinet door and the cabinet body in a wireless manner, thereby achieving the effect of omitting some wires and module chips, and making the structure of the present invention more compact.

8 Claims, 8 Drawing Sheets

(56) References Cited

U.S. PATENT DOCUMENTS

| | | | | |
|---|---|---|---|---|
| 2019/0174917 | A1* | 6/2019 | Diemel | A47B 67/02 |
| 2021/0228008 | A1* | 7/2021 | Stanley, Jr. | G06F 1/1654 |

* cited by examiner

COMPACT MULTIFUNCTIONAL BATHROOM MIRROR CABINET

CROSS-REFERENCE TO RELATED APPLICATIONS

The application claims priority to Chinese patent application No. 2023112581724, filed on Sep. 26, 2023, the entire contents of which are incorporated herein by reference.

TECHNICAL FIELD

The present invention relates to the technical field of smart mirror cabinets, and in particular, to a compact multifunctional bathroom mirror cabinet.

BACKGROUND

Bathroom mirror cabinets are usually placed above the bathroom sink and integrate mirror, storage and other functions, thereby achieving the effect of optimal use of space. In current prior art, bathroom mirrors usually have the following shortcomings: since wiring is difficult, cabinets and cabinet doors are usually controlled individually by different control modules.

Therefore, the structure of existing bathroom mirror cabinets is relatively complex, which leads to a high probability of failure and is not suitable for long-term stable use.

SUMMARY

In view of the problems of the prior art, the present invention provides a compact multifunctional bathroom mirror cabinet, which achieves the effect of compact structure by changing the way of wiring.

In order to solve the above technical problems, the present invention adopts the following technical solutions.

The present invention provides a compact multifunctional bathroom mirror cabinet, including a cabinet body and a cabinet door. The cabinet door is rotatably connected to the cabinet body. The cabinet door is provided with an electric module. The cabinet body is provided with a control module. The electric module is connected with a wireless receiving module, the control module is connected with a wireless transmitting module, and the wireless transmitting module is signal connected with the wireless receiving module.

Furthermore, a hinge module is provided between the cabinet door and the cabinet body, and electricity is conducted between the electric module and the control module through the hinge module.

Further, the hinge module includes a first hinge component and a second hinge component, the first hinge component includes a first main hinge portion provided on the cabinet body and a first auxiliary hinge portion provided on the cabinet door, the first main hinge portion has a hinge seat, the first auxiliary hinge portion has a hinge shaft, and the hinge shaft is rotatably provided on the hinge seat; the main hinge portion and the first auxiliary hinge portion are each covered with an insulating layer, the first main hinge portion is electrically connected with the control module, and the first auxiliary hinge portion is electrically connected with a light-emitting film module.

Further, the second hinge component includes a second main hinge portion provided on the cabinet body and a second auxiliary hinge portion provided on the cabinet door; the second main hinge portion is hinged to the second auxiliary hinge portion, a conducting structure is provided between the second main hinge portion and the second auxiliary hinge portion, and the conducting structure is configured for signal transmission between the control module and the light-emitting film module when the cabinet door is closed on the cabinet body;

the second main hinge portion and the second auxiliary hinge portion are each covered with an insulating layer, a shaft of the second main hinge portion and a seat of the second auxiliary hinge portion are each covered with an insulating structure, and the shaft of the second main hinge portion is hinged to the seat of the second auxiliary hinge portion.

Further, the conducting structure includes a plug socket and a plug post; the plug socket is mounted on the second main hinge portion; the plug post is mounted on the second auxiliary hinge portion; the plug post is configured to be inserted in the plug socket in the case where the cabinet door is closed on the cabinet body; the plug socket is signal connected with the control module; the plug post is signal connected with the electric module:

a current sensor is provided between the control module and the plug socket; the current sensor is configured to sense whether the plug socket is powered on, and the control module is configured to power off the wireless transmitting module and the wireless receiving module when the plug socket and the plug post are powered on.

Further, the control module is connected with an infrared recognition module, and the infrared recognition module is provided on the cabinet body/cabinet door; the control module obtains an action of a person through the infrared recognition module to determine the intention of the person, and the operation specifically includes:

obtaining a body temperature distribution of the human body through the infrared recognition module;

obtaining a body contour of the person according to the body temperature distribution;

obtaining an action of the person according to changes in the body contour of the person;

comparing the action of the person with pre-stored images to obtain the action intention of the person; and if the action intention of the person is determined as opening the cabinet door, powering on the wireless transmitting module and the wireless receiving module.

Further, an end of the cabinet door away from the cabinet body is provided with a mirror, and an end of the cabinet door close to the cabinet body is provided with an enlarging module; the enlarging module is electrically connected with the control module through the hinge module; the enlarging module includes a display screen, a processing module, and a camera; the enlarging module specifically works as follows:

the processing module receives a power-on signal and activates the display screen and the camera;

the camera captures an image in front of the display screen and then projects the image through the display screen;

the processing module obtains the facial information and action of a person according to the image captured by the camera; and the processing module determines, according to the action of the person, a part of the face that the person wants to view, and then the part of the face is enlarged and projected through the display screen.

Further, the cabinet body is provided with a wireless charging module and a partition therein; the partition is provided with a clearance hole; the partition is provided with a limiting structure; the clearance hole is configured to allow an electric toothbrush to pass through; the wireless charging module is provided with a positioning structure for positioning the electric toothbrush, and the limiting structure is configured to extend out to cover a gap between the electric toothbrush and the clearance hole when the electric toothbrush is mounted on the positioning structure.

Further, the wireless charging module includes a base, as well as a pressure sensor, a first charging circuit and a second charging circuit that are all provided on the base; switches are provided between the first charging circuit, the second charging circuit and the control module; the pressure sensor is signal connected with the control module, and the positioning structure is provided on the base in a liftable manner; the positioning structure is configured to switch power states by controlling the switches, and the operation is specifically as follows:

A. the pressure sensor senses whether there is an object on the positioning structure; if so, execute step B, otherwise the control module does not activate the switches;

B. the control module activates the switches, and the switches sense the status of the positioning structure; if the positioning structure is not pressed down, execute step C; otherwise, execute step D;

C. the control module powers on the first charging circuit; and

D. the control module powers on the second charging circuit.

Further, the cabinet body is provided with a humidity sensor, a door opening and closing sensor, and a dehumidification mechanism therein; the humidity sensor is configured to sense the humidity at the hinge module and the partition, and the door opening and closing sensor is configured to sense whether the cabinet door is in a closed state; the dehumidification mechanism includes a hot air module and an ultraviolet module; the hot air module is configured to dehumidify the interior of the cabinet body through hot air when the humidity is higher than a threshold and when the cabinet door is in the closed state; the ultraviolet module is connected with a clock module, and the ultraviolet module is configured to irradiate the interior of the cabinet body with ultraviolet light when the cabinet door is closed and when the current time is in a preset time slot.

Further, the cabinet door is provided with a plurality of first magnets, the cabinet body is provided with a plurality of second magnets, the plurality of first magnets and the plurality of second magnets are provided in a one-to-one corresponding manner, and the first magnets and the second magnets are magnetically attracted to each other.

Beneficial effects of the present invention: the present invention realizes signal transmission between the cabinet door and the cabinet body in a wireless manner, thereby achieving the effect of omitting some wires and module chips, and making the structure of the present invention more compact.

REFERENCE NUMERALS

1—cabinet body, 2—cabinet door, 3—electric module, 4—control module, 5—hinge module, 6—first hinge component, 7—second hinge component, 8—infrared recognition module, 9—wireless transmitting module, 10—wireless receiving module, 11—wireless charging module, 12—partition, 14—limiting structure, 15—humidity sensor, 16—door opening and closing sensor, 17—dehumidification mechanism, 18—second magnet, 19—aromatherapy module, 21—mirror, 22—display screen, 23—processing module, 24—camera, 25—first magnet, 61—first main hinge portion, 62—first auxiliary hinge portion, 63—hinge seat, 64—hinge shaft, 71—second main hinge portion, 72—second auxiliary hinge portion, 73—conducting structure, 74—plug socket, 75—plug post, 76—current sensor, 111—base, 112—pressure sensor, 113—first charging circuit, 114—second charging circuit, 115—switch, 116—pressure sensor, 117—spring, 118—positioning structure, 171—hot air module, and 172—ultraviolet module.

DETAILED DESCRIPTION OF THE EMBODIMENTS

In order for those skilled in the art to gain a better understanding, the present invention will be further described in conjunction with embodiments and accompanying drawings, and the contents mentioned in the embodiments are not intended to limit the present invention. The present invention is described in detail below with reference to the accompanying drawings.

Figure 1:
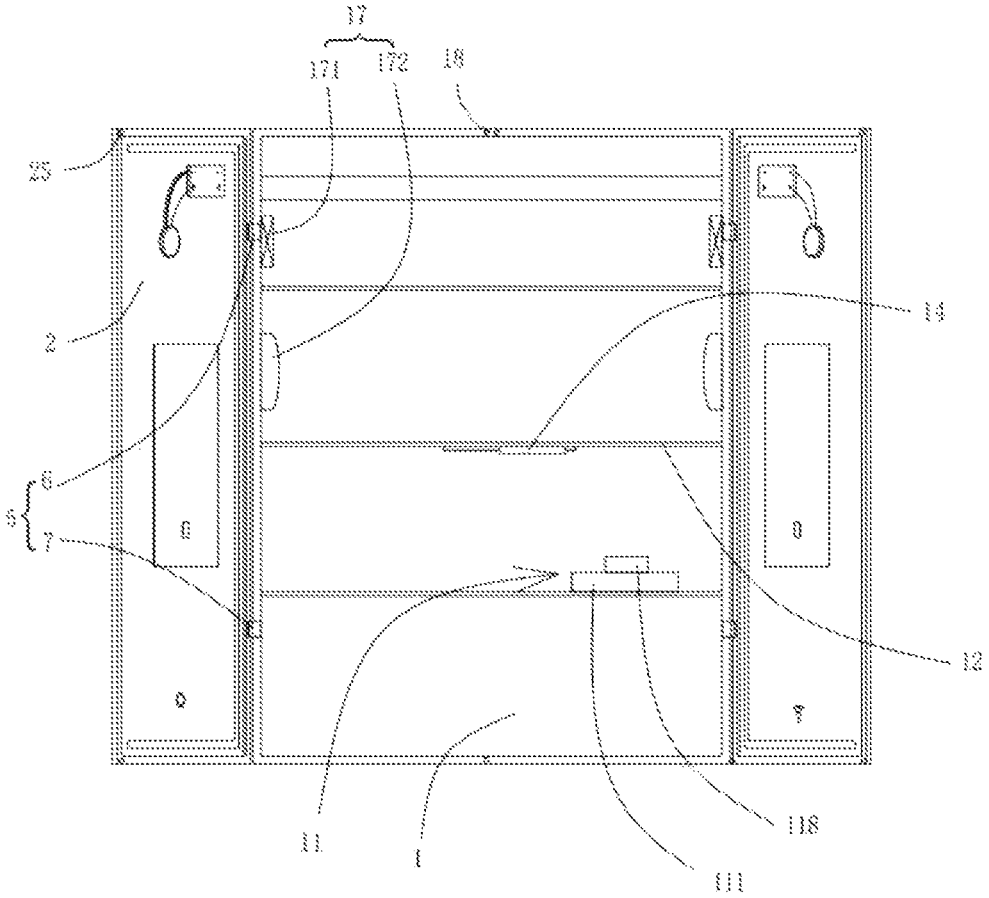
FIG. 1 is a schematic structural diagram of the present invention.
Figure 2:
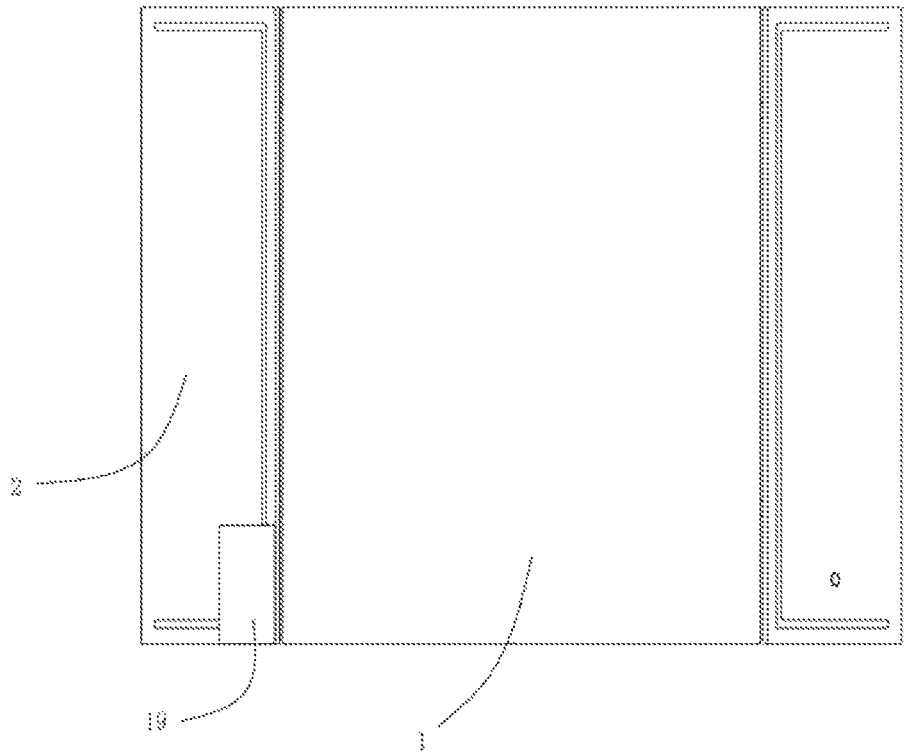
FIG. 2 is a rear view of the present invention.
Figure 3:
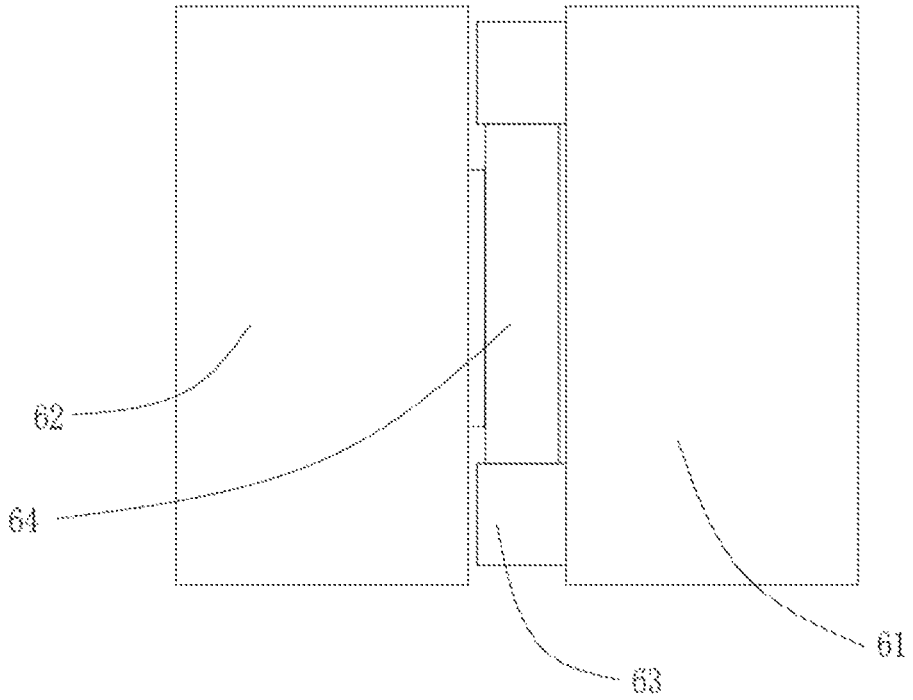
FIG. 3 is a schematic diagram of a first hinge component according to the present invention.
Figure 4:
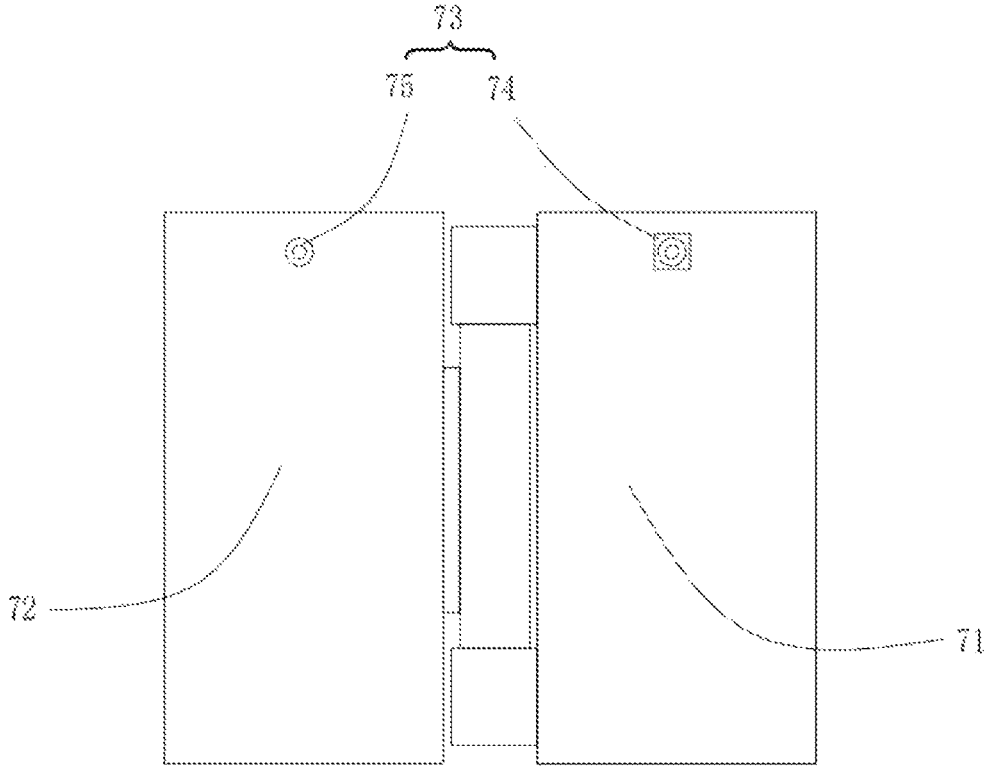
FIG. 4 is a schematic diagram of a second hinge component according to the present invention.
Figure 5:
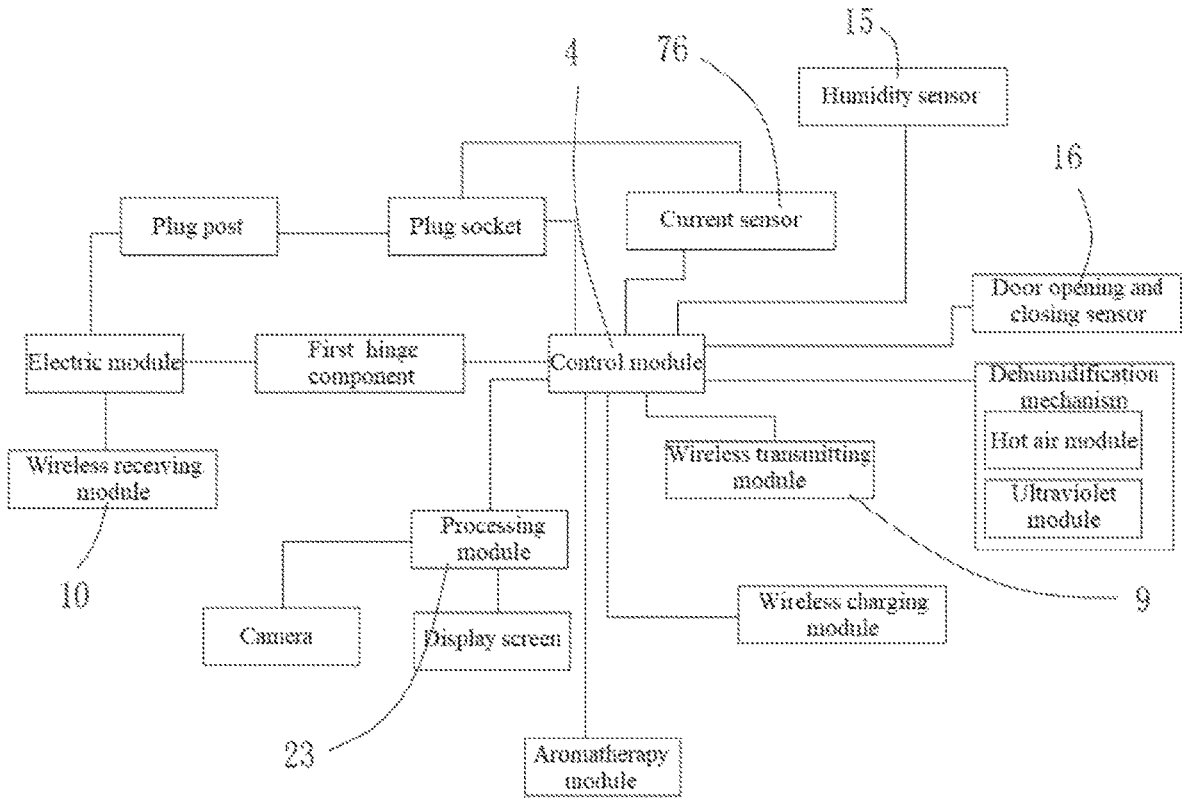
FIG. 5 is a principle block diagram of the present invention.
Figure 6:
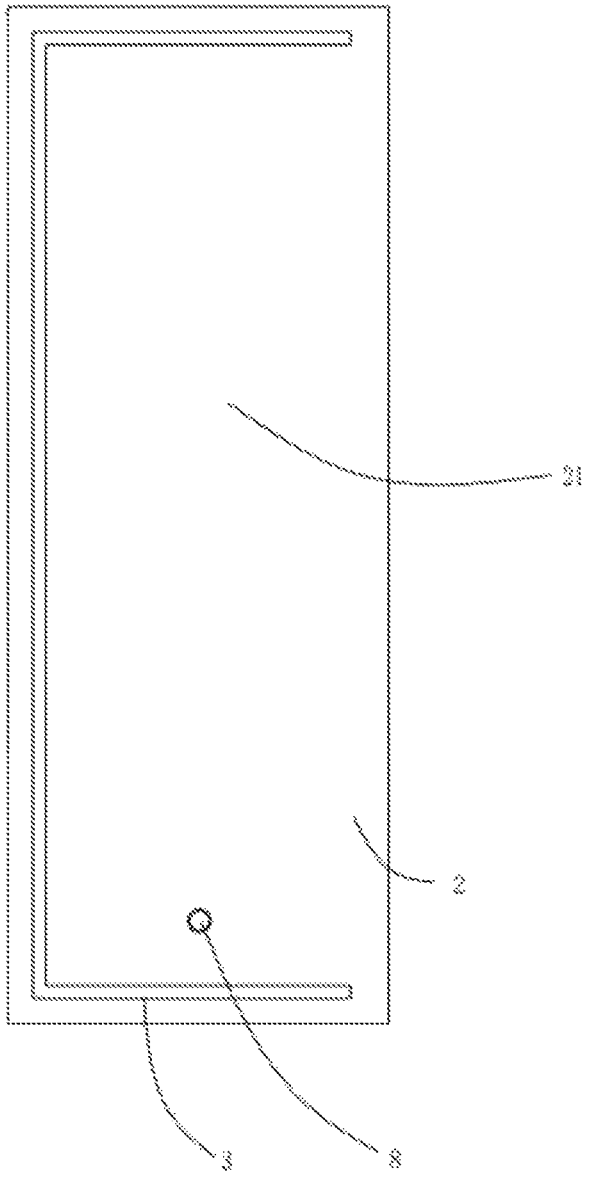
FIG. 6 is a schematic diagram of a cabinet door according to the present invention.
Figure 7:
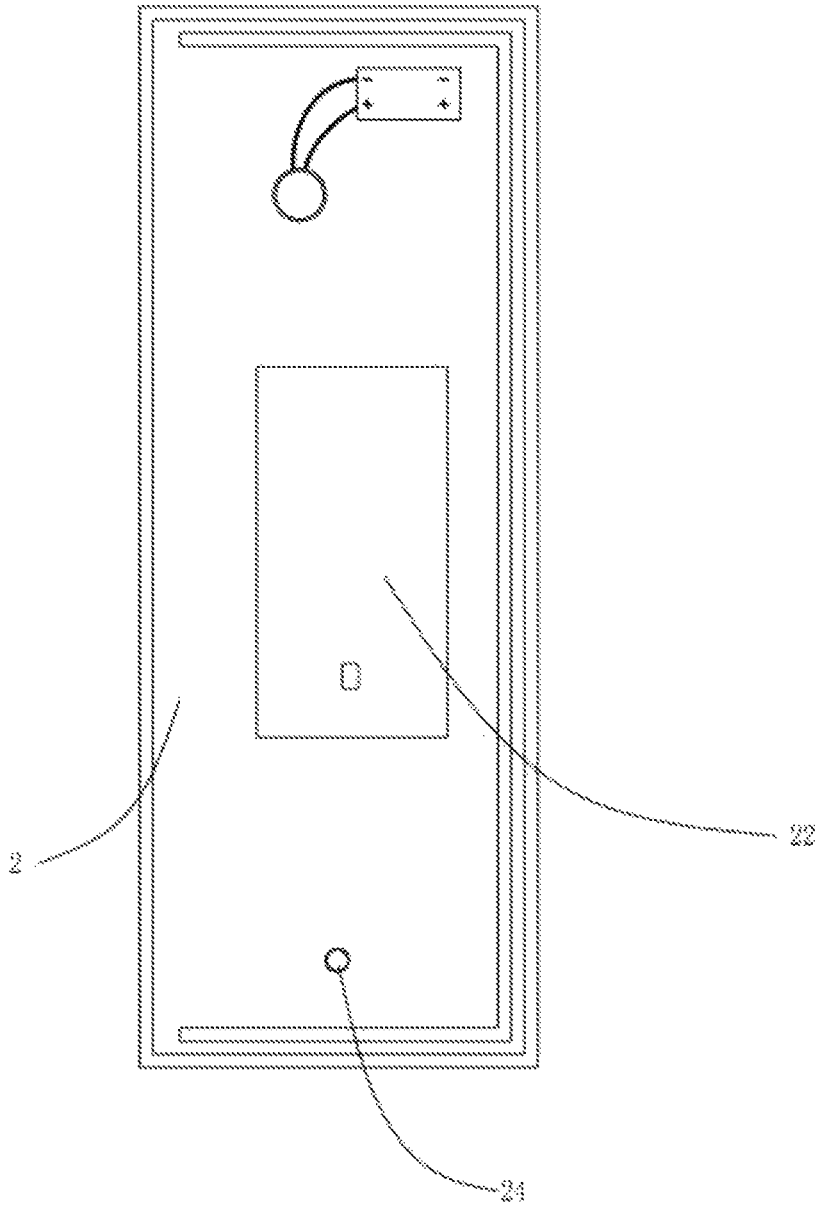
FIG. 7 is a schematic diagram of the cabinet door according to the present invention from another perspective.
Figure 8:
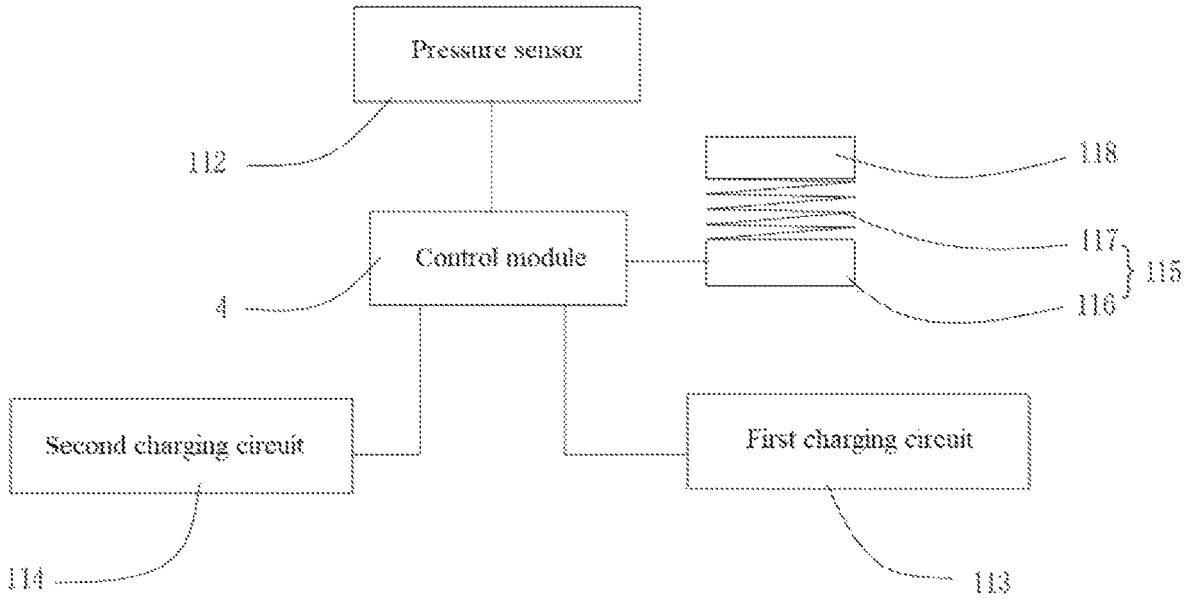
FIG. 8 is a schematic principle diagram of a wireless charging module according to the present invention.

As shown in FIG. 1 to FIG. 8, the compact multifunctional bathroom mirror cabinet of the present invention includes a cabinet body 1 and a cabinet door 2. The cabinet door 2 is rotatably connected to the cabinet body 1. The cabinet door 2 is provided with an electric module 3. The cabinet body 1 is provided with a control module 4. A hinge module 5 is provided between the cabinet door 2 and the cabinet body 1. Electricity is conducted between the electric module 3 and the control module 4 through the hinge module 5. The electric module 3 is connected with a wireless receiving module 10, the control module 4 is connected with a wireless transmitting module 9, and the wireless transmitting module 9 is signal connected with the wireless receiving module 10.

The present invention realizes electricity conduction between the cabinet door 2 and the cabinet body 1 through the hinge components, and realizes signal transmission between the cabinet door 2 and the cabinet body 1 in a wireless manner, thereby achieving the effect of omitting some wires and module chips, and making the structure of the present invention more compact.

In this embodiment, the hinge module 5 includes a first hinge component 6 and a second hinge component 7, the first hinge component 6 includes a first main hinge portion 61 provided on the cabinet body 1 and a first auxiliary hinge portion 62 provided on the cabinet door 2, the first main hinge portion 61 has a hinge seat 63, the first auxiliary hinge portion 62 has a hinge shaft 64, and the hinge shaft 64 is rotatably provided on the hinge seat 63; the main hinge portion 61 and the first auxiliary hinge portion 63 are each covered with an insulating layer, the first main hinge portion 61 is electrically connected with the control module 4, and the first auxiliary hinge portion 62 is electrically connected with a light-emitting film module. According to the present invention, the first main hinge portion 61 and the first auxiliary hinge portion 62 are rotatably connected and electrically conductive by virtue of the hinge seat 63 and the hinge shaft 64, and their non-connected positions are covered with insulating layers to reduce the occurrence of electric leakage and short circuit; and the first main hinge portion 61 is connected to the control module 4 by a wire, and the first auxiliary hinge portion 62 is connected to the electric module 3 by a wire, thus ensuring stable transmission of current.

In this embodiment, the second hinge component 7 includes a second main hinge portion 71 provided on the cabinet body 1 and a second auxiliary hinge portion 72 provided on the cabinet door 2; the second main hinge portion 71 is hinged to the second auxiliary hinge portion 72, a conducting structure is provided between the second main hinge portion 71 and the second auxiliary hinge portion 72, and the conducting structure 73 is configured for signal transmission between the control module 4 and the light-emitting film module when the cabinet door 2 is closed on the cabinet body 1.

Since there are two hinge components between the cabinet door 2 and the cabinet body 1, only the first hinge component 6 is needed for power transmission and in this case, the second hinge component 7 can be used to realize signal transmission. According to the present invention, when the cabinet door 2 is opened, by signal transmission between the wireless transmitting module 9 and the wireless receiving module 10, it can be ensured that the control module 4 controls the transmission of a signal instruction to the electric module 3 when the door is opened. When the cabinet door 2 is in a closed state, the conducting structure 73 is in an ON state. At this time, the control module 4 can directly perform the transmission of signal quality to the electric module 3 through the conducting structure 73, which can reduce the occurrence of external signal interference.

It should be noted that the electric module 3 described in this embodiment includes but is not limited to a light bar and a mirror 21 dehumidification module lamp structure.

In this embodiment, the conducting structure 73 includes a plug socket 74 and a plug post 75; the plug socket 74 is mounted on the second main hinge portion 71; the plug post 75 is mounted on the second auxiliary hinge portion 72; the plug post 75 is configured to be inserted in the plug socket 74 when the cabinet door 2 is closed on the cabinet body 1; the plug socket 74 is signal connected with the control module 4; the plug post is signal connected with the electric module 3; the second main hinge portion 71 and the second auxiliary hinge portion 72 are each covered with an insulating layer, a shaft of the second main hinge portion 71 and a seat of the second auxiliary hinge portion 72 are each covered with an insulating structure, and the shaft of the second main hinge portion 71 is hinged to the seat of the second auxiliary hinge portion 72.

A current sensor 76 is provided between the control module 4 and the plug socket 74; the current sensor 76 is configured to sense whether the plug socket 74 is powered on, and the control module is configured to power off the wireless transmitting module 9 and the wireless receiving module 10 when the plug socket 74 and the plug post 75 are powered on.

According to the present invention, when the cabinet door is closed, by inserting the plug post 75 in the plug socket 74, signal conduction between the power module 3 and the control module 4 is realized, and the wireless transmitting module 9 and the wireless receiving module 10 can be temporarily turned off. When the cabinet door 2 is opened, since the plug post 75 is separated from the plug socket 74, the wireless transmitting module 9 and the wireless receiving module 10 are powered on again, thereby ensuring the effects of stable signal transmission and power saving.

In this embodiment, the control module 4 is connected with an infrared recognition module 8, and the infrared recognition module 8 is provided on the cabinet body 1/cabinet door 2; the control module 4 obtains an action of a person through the infrared recognition module 8 to determine the intention of the person, and the operation specifically includes:

- obtaining a body temperature distribution of the human body through the infrared recognition module 8;
- obtaining a body contour of the person according to the body temperature distribution;
- obtaining an action of the person according to changes in the body contour of the person;
- comparing the action of the person with pre-stored images to obtain the action intention of the person; and if the action intention of the person is determined as opening the cabinet door 2, powering on the wireless transmitting module 9 and the wireless receiving module 10.

Since the bathroom mirror cabinet is located in a bathroom and the bathroom is a relatively private space, the present invention uses the infrared recognition module 8 to obtain the action of the human body. Specifically, since a door opening and closing sensor is provided between the cabinet door 2 and the cabinet body 1, closing the cabinet door 2 will result in a change in the signal of the door opening and closing sensor. According to this signal change, the control module 4 activates the infrared identification module 8, and the body temperature distribution of a person in front of the bathroom mirror cabinet of the present invention is obtained by virtue of the infrared recognition module 8. According to this body temperature distribution, the body contour and action of the person can be obtained. Subsequently, when the person needs to open the cabinet door 2, the predicted action of the person is reaching out a hand towards a side of the cabinet door 2. At this time, this action is obtained by the infrared recognition module 8 and compared with the pre-stored images by the control module 4. The control module 4 determines that the person needs to open the cabinet door 2 and activates the wireless transmitting module 9 and the wireless receiving module 10 in advance to ensure that the wireless transmitting module 9 and the wireless receiving module 10 are already in a normal working state when the cabinet door 2 is opened, thereby ensuring that there is always a signal transmission channel between the control module 4 and the electric module 3.

In this embodiment, an end of the cabinet door 2 away from the cabinet body 1 is provided with a mirror 21, and an end of the cabinet door 2 close to the cabinet body 1 is provided with an enlarging module; the enlarging module is electrically connected with the control module 4 through the hinge module 5; the enlarging module includes a display screen 22, a processing module 23, and a camera 24; the enlarging module specifically works as follows:

the processing module 23 receives a power-on signal and activates the display screen 22 and the camera 24;

the camera 24 captures an image in front of the display screen 22 and then projects the image through the display screen 22;

the processing module 23 obtains the facial information and action of a person according to the image captured by the camera 24; and the processing module 23 determines, according to the action of the person, a part of the face that the person wants to view, and then the part of the face is enlarged and projected through the display screen 22.

When the cabinet door 2 is closed, the person can only use the mirror 21; and after the cabinet door 2 is opened, the person can project the picture captured by the camera 24 onto the display screen 22 to achieve the effect of enlarging the partial information of the face, such that the person can zoom in on the details of the face to better work on the details of the face during makeup, skin care and other actions, thereby improving the effects of makeup and skin care.

In order to ensure that privacy is not compromised, the camera 24 of the present invention is always offline, and it is only configured to project the images of persons to the display screen 22. After the camera 24 is shut down due to the closing of the cabinet door 2, the data captured by the camera 24 will be cleared in time.

In addition, the enlarging module is also powered and controlled by the control module 4, and the start-up of the processing module 23 is triggered by opening the cabinet door 2. The enlarging module is also provided with a brightness control circuit for adjusting the display brightness of the display screen 22 according to the ambient brightness of the space where the present invention is located, thereby ensuring appropriate brightness.

In this embodiment, the cabinet body 1 is provided with a wireless charging module 11 and a partition 12 therein; the partition 12 is provided with a clearance hole; the partition 12 is provided with a limiting structure 14; the clearance hole is configured to allow an electric toothbrush to pass through; the wireless charging module 11 is provided with a positioning structure 118 for positioning the electric toothbrush, and the limiting structure 14 is configured to extend out to cover a gap between the electric toothbrush and the clearance hole when the electric toothbrush is mounted on the positioning structure 118.

Specifically, the limiting structure 14 may be composed of an electric push rod and a baffle. The baffle has an avoidance hole matching the shape of the electric toothbrush. When using the electric toothbrush, take the electric toothbrush out of the wireless charging module 11 first. At this time, the baffle, controlled by the electric push rod, will retreat so that the electric toothbrush can be taken out from the relief hole. After use, the electric toothbrush is put back on the wireless charging module 11, and the baffle, controlled by the electric push rod, extends forward to limit the position of the electric toothbrush, thereby positioning the electric toothbrush and preventing water droplets attached to the electric toothbrush from falling on the wireless charging module 11.

Further, the wireless charging module 11 includes a base 111, as well as a pressure sensor 112, a first charging circuit 113 and a second charging circuit 114 that are all provided on the base 111; switches 115 are provided between the first charging circuit 13, the second charging circuit 114 and the control module 4; the pressure sensor 112 is signal connected with the control module 4, and the positioning structure 118 is provided on the base 11 in a liftable manner; the positioning structure 118 is configured to switch power states by controlling the switches 115, and the operation is specifically as follows:

A. the pressure sensor 112 senses whether there is an object on the positioning structure 118; if so, execute step B, otherwise the control module does not activate the switches 115;

B. the control module 4 activates the switches 115, and the switches 115 sense the status of the positioning structure 118; if the positioning structure 118 is not pressed down, execute step C; otherwise, execute step D;

C. the control module 4 powers on the first charging circuit 113; and

D. the control module 4 powers on the second charging circuit 114.

The wireless charging module 11 of the present invention integrates two charging circuits, so that the present invention is capable of charging different electrical products at different power levels, ensuring charging efficiency and safety. The switches 115 preferably include a pressure sensor 116 and a spring 117. When a mobile phone is charged, the mobile phone will press down the base 111, that is, the pressure applied by the base 111 to the pressure sensor 116 through the spring 117 will increase, and then it is determined that the electrical product being charged is not an electric toothbrush, and in this case the present invention can be directly switched to the second charging circuit 114 to work.

In addition, the pressure sensor 116 and the pressure sensor 112 can also work together to control the action of the limiting structure 14: when step C is being executed according to the above-described steps, i.e. when the electric toothbrush is placed on the base 111, the limiting structure 14 can start moving; and when step D is being executed, i.e. when no electric toothbrush is placed on the wireless charging module 11 for charging, and the limiting structure 14 does not move at this time, thereby avoiding malfunction of the limiting structure 14.

In order to avoid overcharging, when step C is being executed, the control module 4 starts timing. After the timing reaches 1 hour or other preset time, regardless of whether the electric toothbrush is still on the wireless charging module 11, the first charging circuit 113 will be powered off and stop charging.

In this embodiment, the cabinet body 1 is provided with a humidity sensor, a door opening and closing sensor, and a dehumidification mechanism 17 therein; the humidity sensor is configured to sense the humidity at the hinge module 5, the partition 12, and the wireless charging module 11; the door opening and closing sensor is configured to sense whether the cabinet door 2 is in a closed state; the dehumidification mechanism 17 includes a hot air module 171 and an ultraviolet module 172; the hot air module 171 is configured to dehumidify the interior of the cabinet body 1 through hot air when the humidity is higher than a threshold and when the cabinet door 2 is in the closed state; the ultraviolet module 172 is connected with a clock module, and the ultraviolet module 172 is configured to irradiate the interior of the cabinet body 1 with ultraviolet light when the cabinet door 2 is closed and when the current time is in a preset time slot.

In order to prevent the hinge module 5 from rusting or the electrical components from being short-circuited due to excessive humidity in the cabinet body 1, the present invention uses a humidity sensor to monitor the humidity in the cabinet body 1 at all times. If the humidity in the cabinet body 1 exceeds a preset threshold, after the cabinet door 2 is closed, the hot air module 171 will take away the moisture in the cabinet 1 with hot gas by blowing hot air and then discharging the gas, and then the ultraviolet module 172 disinfects and sterilizes the interior of the cabinet 1 to avoid bacterial growth caused by heavy moisture.

In this embodiment, the cabinet door 2 is provided with a plurality of first magnets 25, the cabinet body 1 is provided with a plurality of second magnets 18, the plurality of first magnets 25 and the plurality of second magnets 18 are provided in a one-to-one corresponding manner, and the first magnets 25 and the second magnets 18 are magnetically attracted to each other. The first magnets 25 cooperate with the second magnets 18 to ensure the stability of the closed cabinet door 2 and avoid false triggering of electrical components or safety accidents caused by the automatic opening of the cabinet door 2.

In this embodiment, the cabinet body 1 is further provided with an aromatherapy module 19. The aromatherapy module 19 includes a mounting base, a heating mechanism, a blowing mechanism, a water flow detection module, and a timing module. The mounting base is provided on one side of the cabinet body 1 and configured to carry incense. The heating mechanism is configured to heat the incense in the mounting base. The blowing mechanism is configured to blow the incense scent from the mounting base to the outside. The water flow detection module is configured to detect the status of the water mechanism in the space where the bathroom mirror cabinet is located. The timing module is configured to set an aromatherapy time. The control module 4 periodically controls the operation of the heating mechanism and the blowing mechanism according to the aromatherapy time.

Specifically, the water flow detection module can be configured to detect the working status of toilets, showers and other mechanisms. For example, after a person uses the toilet, the water flow detection module detects that the water inside the toilet has been flowing for a long time and in a large amount, and then transmits a signal to the control module 4, and then the heating mechanism and the blowing mechanism, controlled by the control module 4, start to operate, thereby emitting fragrance to cover the smell of human feces. For another example, when water flows from a shower for a long time, it is determined that a person is taking a bath. At this time, the aromatherapy module 19 operates to emit fragrance, and the person can smell the fragrance when he or she leaves the shower room after taking a bath, thereby improving the experience of the person.

The foregoing is merely illustrative of the preferred embodiments of the present invention and is not intended to limit the present invention in any form. While the present invention has been disclosed as above by way of the preferred embodiments, it is not intended to be limiting of the present invention. Any person skilled in the art may make some changes or equivalent embodiments modified as equivalents without departing from the scope of the present invention on the basis of the above-mentioned technical contents; any of changes, equivalent, and modifications made to the foregoing embodiments without departing from the spirit of the technical solution of the present invention in accordance with the technical essence of the present invention is within the scope of the technical solution of the present invention.

What is claimed is:

1. A compact multifunctional bathroom mirror cabinet, comprising a cabinet body and a cabinet door, the cabinet door being rotatably connected to the cabinet body, the cabinet door being provided with an electric module, the cabinet body being provided with a control module, characterized in that:

the electric module is connected with a wireless receiving module, the control module is connected with a wireless transmitting module, and the wireless transmitting module is signal connected with the wireless receiving module;

a hinge module is provided between the cabinet door and the cabinet body, and electricity is conducted between the electric module and the control module through the hinge module;

the hinge module comprises a first hinge component and a second hinge component, the first hinge component comprises a first main hinge portion provided on the cabinet body and a first auxiliary hinge portion provided on the cabinet door, the first main hinge portion has a hinge seat, the first auxiliary hinge portion has a hinge shaft, and the hinge shaft is rotatably provided on the hinge seat; the main hinge portion and the first auxiliary hinge portion are each covered with an insulating layer, the first main hinge portion is electrically connected with the control module, and the first auxiliary hinge portion is electrically connected with a light-emitting film module;

the second hinge component comprises a second main hinge portion provided on the cabinet body and a second auxiliary hinge portion provided on the cabinet door, the second main hinge portion is hinged to the second auxiliary hinge portion, a conducting structure is provided between the second main hinge portion and the second auxiliary hinge portion, and the conducting structure is configured for signal transmission between the control module and the light-emitting film module when the cabinet door is closed on the cabinet body; and the second main hinge portion and the second auxiliary hinge portion are each covered with an insulating layer, a shaft of the second main hinge portion and a seat of the second auxiliary hinge portion are each covered with an insulating structure, and the shaft of the second main hinge portion is hinged to the seat of the second auxiliary hinge portion.

2. The compact multifunctional bathroom mirror cabinet according to claim 1, characterized in that the conducting structure comprises a plug socket and a plug post, the plug socket is mounted on the second main hinge portion, the plug post is mounted on the second auxiliary hinge portion, the plug post is configured to be inserted in the plug socket in the case where the cabinet door is closed on the cabinet body; the plug socket is signal connected with the control module; the plug post is signal connected with the electric module;

a current sensor is provided between the control module and the plug socket, the current sensor is configured to sense whether the plug socket is powered on, and the control module is configured to power off the wireless transmitting module and the wireless receiving module when the plug socket and the plug post are powered on.

3. The compact multifunctional bathroom mirror cabinet according to claim 1, characterized in that the control module is connected with an infrared recognition module, and the infrared recognition module is provided on the cabinet body/cabinet door; the control module obtains an action of a person through the infrared recognition module to determine the intention of the person, and the operation specifically comprises:

obtaining a body temperature distribution of the human body through the infrared recognition module;

obtaining a body contour of the person according to the body temperature distribution;

obtaining an action of the person according to changes in the body contour of the person;

comparing the action of the person with pre-stored images to obtain the action intention of the person; and if the action intention of the person is determined as opening the cabinet door, powering on the wireless transmitting module and the wireless receiving module.

4. The compact multifunctional bathroom mirror cabinet according to claim 1, characterized in that an end of the cabinet door away from the cabinet body is provided with a mirror, and an end of the cabinet door close to the cabinet body is provided with an enlarging module; the enlarging module is electrically connected with the control module through the hinge module; the enlarging module comprises a display screen, a processing module, and a camera; the enlarging module specifically works as follows:

the processing module receives a power-on signal and activates the display screen and the camera;

the camera captures an image in front of the display screen and then projects the image through the display screen;

the processing module obtains the facial information and action of a person according to the image captured by the camera; and the processing module determines, according to the action of the person, a part of the face that the person wants to view, and then the part of the face is enlarged and projected through the display screen.

5. The compact multifunctional bathroom mirror cabinet according to claim 1, characterized in that the cabinet body is provided with a wireless charging module and a partition therein, the partition is provided with a limiting structure, and the wireless charging module is provided with a positioning structure for positioning the electric toothbrush.

6. The compact multifunctional bathroom mirror cabinet according to claim 5, characterized in that the wireless charging module comprises a base, as well as a pressure sensor, a first charging circuit and a second charging circuit that are all provided on the base; switches are provided between the first charging circuit, the second charging circuit and the control module; the pressure sensor is signal connected with the control module, and the positioning structure is provided on the base in a liftable manner; the positioning structure is configured to switch power states by controlling the switches, and the operation is specifically as follows:

A. the pressure sensor senses whether there is an object on the positioning structure; if so, execute step B, otherwise the control module does not activate the switches;

B. the control module activates the switches, and the switches sense the status of the positioning structure; if the positioning structure is not pressed down, execute step C; otherwise, execute step D;

C. the control module powers on the first charging circuit; and

D. the control module powers on the second charging circuit.

7. The compact multifunctional bathroom mirror cabinet according to claim 5, characterized in that the cabinet body is provided with a humidity sensor, a door opening and closing sensor, and a dehumidification mechanism therein; the humidity sensor is configured to sense the humidity at the hinge module and the partition, and the door opening and closing sensor is configured to sense whether the cabinet door is in a closed state; the dehumidification mechanism comprises a hot air module and an ultraviolet module, the hot air module is configured to dehumidify the interior of the cabinet body through hot air when the humidity is higher than a threshold and when the cabinet door is in the closed state, the ultraviolet module is connected with a clock module, and the ultraviolet module is configured to irradiate the interior of the cabinet body with ultraviolet light when the cabinet door is closed and the current time is in a preset time slot.

8. The compact multifunctional bathroom mirror cabinet according to claim 5, characterized in that the cabinet door is provided with a plurality of first magnets, the cabinet body is provided with a plurality of second magnets, the plurality of first magnets and the plurality of second magnets are provided in a one-to-one corresponding manner, and the first magnets and the second magnets are magnetically attracted to each other.

* * * * *